United States Patent [19]

Scaletta et al.

[11] 4,107,634

[45] Aug. 15, 1978

[54] DETENT MECHANISM ESPECIALLY FOR MICROWAVE DRUM ATTENUATOR

[75] Inventors: Ronald C. Scaletta; George Capek, both of Frederick, Md.

[73] Assignee: Weinschel Engineering Co., Gaithersburg, Md.

[21] Appl. No.: 745,037

[22] Filed: Nov. 24, 1976

[51] Int. Cl.[2] ..... H01P 1/22; G05G 5/06

[52] U.S. Cl. ..... 333/81 A; 74/527; 200/291

[58] Field of Search ..... 74/527, 10.41, 526; 64/29; 200/291; 333/81 A

[56] References Cited

U.S. PATENT DOCUMENTS

| | | | |
|---|---|---|---|
| 2,461,447 | 2/1949 | Siesel | 64/29 |
| 2,637,987 | 5/1953 | Hill et al. | 64/29 |
| 2,854,830 | 10/1958 | Steinbrecker | 64/29 |
| 3,260,805 | 7/1966 | Pihl | 74/527 X |
| 4,001,736 | 1/1977 | Malcolm et al. | 333/81 A |

FOREIGN PATENT DOCUMENTS

| | | | |
|---|---|---|---|
| 406,353 | 8/1966 | Switzerland | 200/291 |

*Primary Examiner*—Allan D. Herrmann

*Attorney, Agent, or Firm*—William D. Hall; Geoffrey R. Myers

[57] ABSTRACT

The present invention relates to a detent mechanism for a rotatable body to bias the body in any of a multiplicity of predetermined angular positions. The body has a projecting element of polygon shape, extending from its rear end. The element defines a cavity in it. A projection extends inwardly from the wall of the cavity. The projection cooperates with a stop to limit the angular rotation of the body. The device is designed to permit different polygons to be used so that the number of angular positions at which the body stops may be changed. The detent mechanism is shown in conjunction with a microwave drum attenuator since it is desirable, in such an attenuator to reduce undesirable forces on the drum attenuator.

23 Claims, 9 Drawing Figures

FIG. 5
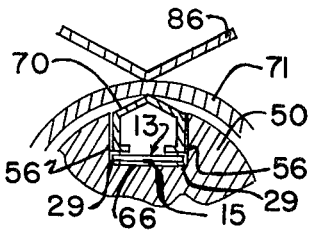
FIG. 1
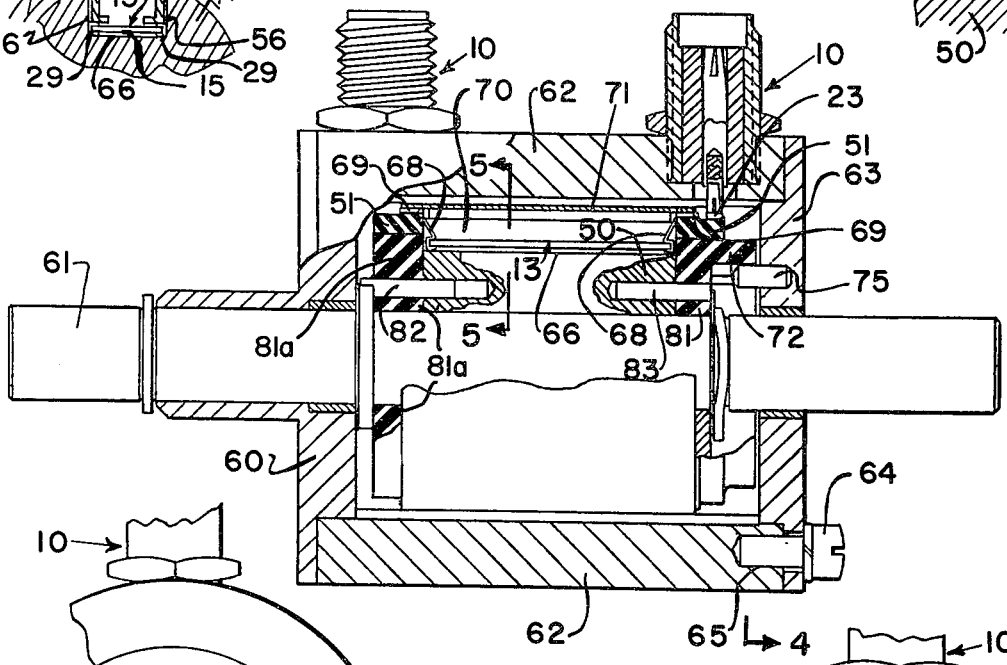
FIG. 6
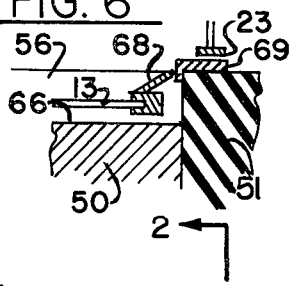
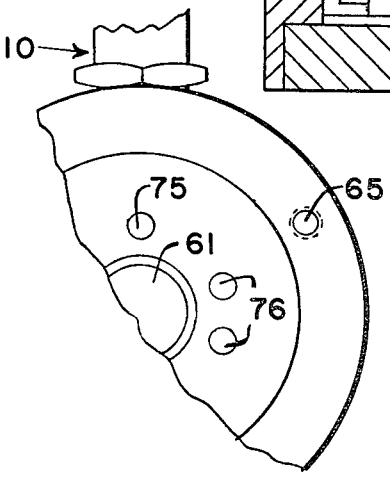
FIG. 4
FIG. 3
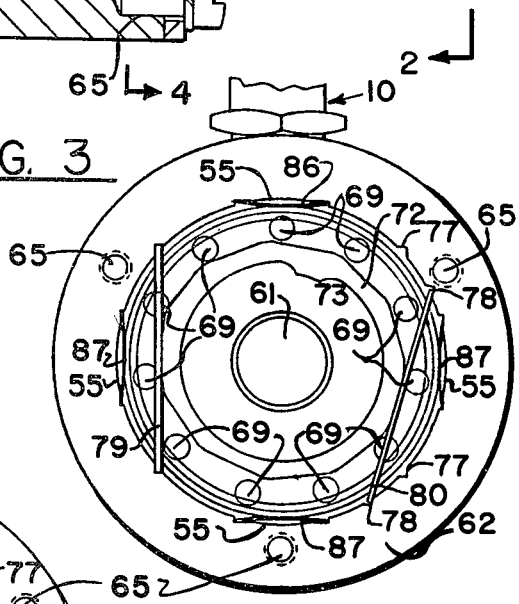
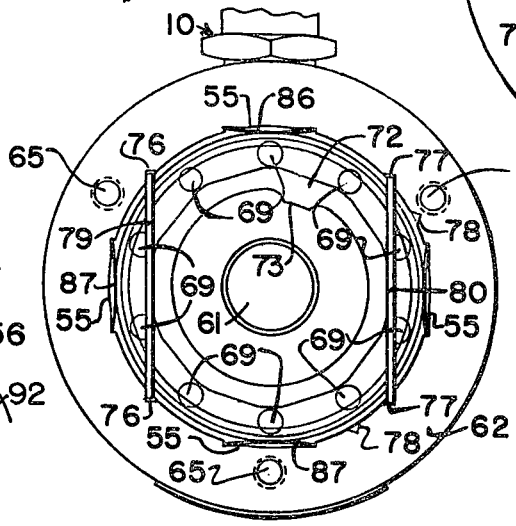
FIG. 2
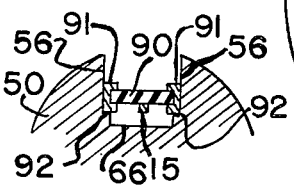
FIG. 9
FIG. 7
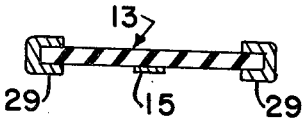
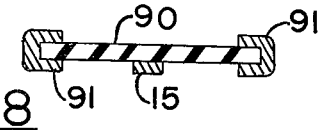
FIG. 8

DETENT MECHANISM ESPECIALLY FOR MICROWAVE DRUM ATTENUATOR

BACKGROUND OF THE INVENTION

It has been customary, in broadband microwave attenuators, as in mechanic arts generally, to use a spring-ball detent mechanism to cause the rotatable part of the attenuator to stop in predetermined angular positions, see for example, U.S. Pat. No. 3,805,209 to Robert M. Keranen, granted Apr. 16, 1974, for "Miniature Adjustable Attenuator". Detent mechanisms of the kind described in the aforesaid patent are extremely old, perhaps going back at least a century.

There are many electrical devices, such as broadband microwave attenuators, for example, in which the relation of one part to another is very critical and their relative positions must be accurately maintained. When the prior art detent mechanisms apply relatively large forces to such an electrical device over periods of years, there is a deterioration of accuracy. A main object of this invention is to overcome this difficulty.

It is an object of this invention to provide an improved detent mechanism that is low in cost.

Another object of the invention is to provide a detent mechanism in which the forces are balanced when the rotatable part of the mechanism is rotated.

A further object of the invention is to provide a detent mechanism which has less wear than the detent mechanisms of the prior art.

Still another object of the invention is to provide a detent mechanism having a greater reliability than has heretofore been possible.

Still another object of the invention is to provide a detent mechanism in which less torque is required, to move the rotatable body out of its detented position, than has heretofore been required.

A further object of the invention is to provide a detent mechanism having special utility in combination with an electrical switch which has a multiplicity of angular positions into which it may be placed.

A still further object of the invention is to provide a detent mechanism which when employed in combination with a broadband microwave step attenuator provides improved characteristics.

Other objects and advantages of the invention will appear as this description proceeds.

SUMMARY OF THE INVENTION

A rotatable drum has a projection of polygon cross-section extending therefrom. Each side of the polygon is of substantially equal length. First and second elongated resilient bars respectively engage opposite faces of the polygon to cause the polygon to be biased to stop at predetermined angular positions. When there are an even number of sides to the polygon, the two resilient bars are parallel. A housing surrounds the polygon and has two notches to receive the first elongated resilient bar. When opposite ends of that resilient bar are positioned in the aforesaid two notches, the middle section of the resilient bar is in direct face to face contact with one side of the polygon. The housing has a second pair of notches to receive the second resilient bar and place it in a position parallel to the first elongated resilient bar.

The number of predetermined positions in which the rotatable drum may be biased to stop is subject to change by changing the polygons. Thus, if it is desired to bias the drum to stop in ten angular positions, a polygon with ten sides of equal length is used, whereas if the drum is to stop in eleven angular positions a polygon with eleven sides is used.

When the polygon having an even number of sides is replaced with one having an odd number of sides, the second elongated resilient bar must be positioned at a different angle than it was located when a polygon with an equal number of sides was used. Therefore, an additional pair of notches is located in said housing to receive the second resilient bar in an alternate position where it will always be in a face to face relationship with a side of a polygon having an odd number of sides.

The new detent mechanism may be employed in combination with an electrical switching arrangement which has a plurality of switching circuits, one for each side of the polygon.

In an improved version of the invention, the switching arrangement may be part of a microwave broadband step attenuator. Such an attenuator employs a number of cards, each card having a layer of resistance material. Each card has a different amount of resistance than the others so that it provides the attenuator with a different value of attenuation than the other cards. The desired card is selected by rotating the drum of the attenuator, which in turn rotates the projection of polygon shape. There is synergism in the combination of the aforesaid broadband step attenuator and the particular detent mechanism employed.

BRIEF DESCRIPTION OF THE DRAWINGS

FIG. 1 is a cross-sectional view of a step attenuator embodying the detent mechanism.

FIG. 2 is a right-end view of the step attenuator of FIG. 1, with the end plate 63 (and its associated bolts 44) removed.

FIG. 3 is an end view similar to FIG. 2 except that the polygon has an odd number of sides instead of an even number of sides.

FIG. 4 is a view taken along line 4—4 of FIG. 1.

FIG. 5 is a cross-sectional view taken along line 5—5 of FIG. 1.

FIG. 6 is a cross-section of a detail showing how the inner conductor of the card attenuator is connected to the input (or output) coaxial connector.

FIG. 7 is a cross-sectional view of the card 13 with the contact spring 68 omitted.

FIG. 8 is a cross-sectional view of the preferred form of card for use in the card attenuator.

FIG. 9 is a cross-sectional view of the preferred shape of the trough in drum 50, utilizing the preferred form of card shown in FIG. 8.

DETAILED DESCRIPTION OF THE INVENTION

The step attenuator described in FIG. 1 is designed to provide a constant broadband characteristic impedance from DC to at least 2 GHz and preferably higher, for example, 4 GHz. Such step attenuators are frequently used in various forms of measuring instruments and are provided with a plurality of cards, each providing a suitable value of attenuation. The operator selects the desired attenuator by rotating the shaft of 61 to bring one of the numerous cards into operating condition.

The attenuator has a stationary main body comprising a left end body section 60 secured in fixed relation to a cylindrical body section 62. A right end plate 63 is detachably secured to the cylindrical section 62 by bolts 64 which mate with threaded holes 65 in section 62. Two coaxial connectors 10 have outside threads which mate with the threads in holes passing through section 62. A stationary pin 75 is carried by right end section 63. If desired the stationary pin may be placed in any one of many alternate positions 76. Springs 86 and 87, and resilient bars 79 and 80 are also stationary.

The rotatable parts of the attenuator comprise: shaft 61, drum 50, plastic polygon-shaped projection 72 with projection 73, attenuator card 13 with its associated inner conductor 15, spring contacts 68, contacts 69, U-shaped spring 70, annular ring 71, and pins 82 and 83 which hold the rotating parts together.

The main rotatable drum 50 has a plurality of longitudinal notches or grooves 66–56 (FIG. 5) running longitudinally along its outer surface. One of these grooves is shown in FIG. 5 and has, in addition to the bottom wall 66 of the groove, two up-standing walls 56 so that the groove is in the shape of a trough running longitudinally along the drum and parallel to the axis of the attenuator. Each groove is provided with its own individual card attenuator 13 which has an inner conductor 15 running along the card midway between its longitudinal edges. Each end of the inner conductor 15 has a spring contact 68 which engages a contact strip 69 mounted on the sleeve 51 of insulating material. There are two sleeves carried by the drum 50, one adjacent to the right hand ends of the grooves 66–56, and the other carried adjacent the left hand ends of the grooves.

A detailed explanation of the electrical theory of the attenuator is set forth in the copending application of Ronald C. Scaletta, Ser. No. 744,897, filed on even data herewith, entitled "BROADBAND MICROWAVE CARD ATTENUATOR". An alternative construction for the attenuator card 13 is shown in FIG. 1 of U.S. Pat. No. 3,157,846 to Bruno O. Weinschel, granted Nov. 7, 1964, entitled "Card Attenuator for Microwave Frequencies".

The preferred forms for the trough 56–66 and the card are shown in FIGS. 8 and 9. The card 90 of insulating material has the ground conductor 15 running along its lower middle longitudinal area, and has two ground conductors 91 which are painted on a short portion of the card 90 contiguous with each longitudinal edge, including along both longitudinal side walls. Alternatively all of the conductors 15 and 91 may be applied using printed circuit techniques. In this case, the thicknesses of conductors 15 and 91 are the same. The ground conductors 91 rest on the two internal ledges, or steps 92, respectively positioned along the two side walls 56. The two steps 92 position the card 90 and the inner conductor 15 a precise and accurately defined distance from the bottom wall 66 of the longitudinal trough or groove 56–66.

Each of the two coaxial connectors 10 have a spring pressed contact arm 23 on its inner conductor which arm 23 engages its complementary contact strip 69. The attenuator of FIG. 2 has ten cards 13. Each time the drum is rotated one-tenth of a revolution, another card 13 is brought into the top position and its contact strips 69 engage their respective contact arms 23 to complete the circuit.

The drawings of this application show a card of the type described in detail in said Scaletta application. The card 13 has ground conductors 29 along each longitudinal edge of the card. These ground connectors 29 are in contact with bottom wall 66 of the metal drum 50. In order to hold the card in its desired position, an elongated U-shaped spring 70 (see in particular the cross-sectional view of FIG. 5), presses downwardly on the ground conductors 29 holding them tightly against the bottom wall 66 of the groove in drum 50. The upper end of the spring 70 engages an annular ring 71. There is a spring member 86 and three additional spring members 87 which are located in indents 55 in the inner wall of the body 62. Springs 86 and 87 press against annular ring 71, to cause annular ring 71 and housing 62 to be of the same ground potential. The springs 86 and 87 are identical, except springs 86 must have holes through which the coaxial connectors 10 pass.

Irrespective of which one of the several cards 13 of the attenuators is moved into operating position, the electrical current paths through the device are as follows: The outer conductor of coaxial conductor 10 is connected to the cylindrical body member 62 which is part of the body 60. Therefore, the walls 66 and 56 as well as the ground conductors 29, the spring 70, and the annular ring 71 are all part of the outer conductor of the coaxial line. The inner conductor of the entire attenuator includes points 23, contact strips 69, contact springs 68 and the inner conductor 15. A resistive layer may be located on the lower face (FIG. 5) of the card 13 between inner conductor 15 and ground conductors 29.

The inner conductor 15 is very accurately spaced above the wall 66 due to the thickness of the material forming ground conductor 29. Hence, there is a very accurate and carefully controlled relationship between the inner conductor 15 and the wall 66. Due to the close proximity of these two parts, there is an intense field between the inner conductor 15 and the wall 66. However, in view of the considerable distance between the inner conductor 15 and the spring 70, there is only a small field in the region above the card 13. Therefore, it is unnecessary to provide accurate shape and/or positioning of the spring 70 in order to preserve the broadband characteristics of the attenuator. In view of the fact that a very high degree of accuracy should be maintained between some of the parts, it is highly desirable to minimize the forces created by the detent mechanism. The new detent mechanism of this application accomplishes the above result.

Projecting to the rear of the drum 50 is a plastic element 81 which is connected for synchronous rotation with body 50 by a pin 83. Plastic projection 81 has a further projection 72 which provides for an annular cavity between its inner surface and the outer surface of shaft 61 (see FIGS. 2 and 3) except for the fact that a projection 73 extends inwardly. The rear cover 63 for the attenuator carries pin 75 which normally rides against the inner surface of projection 72, that is it rides in the cavity between the inner surface of element 72 and the outer surface of shaft 61 (FIGS. 2 and 3).

Since the pin 75 is stationary, it will stop the rotation of the drum 50 when the pin 75 is engaged by the projection 73. Since projection 73 extends inwardly half way between two of the contact elements 69, all ten (or eleven as the case may be) of the card attenuators may be brought into the operating circuit by rotating the drum 50 from a position where a pin 75 engages one side of the projection 73 to the angular position where that pin engages the other side of the angular projection 73.

The polygon shaped projection 72 has an even number of sides in FIG. 2 because that attenuator employs an even number of steps (card attenuators), in this case ten. When the drum 50 has ten card attenuators, two parallel resilient bars 79 and 80 are employed in a position shown. The bar 79 is held in place since its two free ends are held in notches 76 and its midsection is in face to face contact with one of the sides of the polygon shaped projection 72. Similarly, resilient bar 80 has upper and lower ends respectively in notches 77 and a midsection which engages a face of the polygon opposite to the face engaged by bar 79. In the event that it is desired to substitute an attenuator drum having eleven attenuator cards, in place of the one having ten cards, many of the same parts may still be used. For example, the coaxial connectors 10, the body 60, the cylindrical body element 62, the end plate 63 and the pin 75 may remain exactly the same. The new rotatable drum position 50 will in this case have eleven instead of ten attenuators, and similarly, the projection 72 will have eleven sides instead of ten sides. In order to accommodate this change, the resilient bar 80 will have its two free ends inserted into two notches 78 so that the midsection of the bar 80 is in face to face contact with one of the faces of the polygon shaped projection 72.

It follows that when the rotatable drum 50 is rotated to any one or more of the predetermined positions at which it connects a card attenuator 13 to the coaxial connectors 10, the resilient bars 79 and 80 provide a simple, inexpensive and reliable detenting operation tending to bias the drum 50 in said positions. In view of the extreme accuracy and long life required in a device such as step attenuators, it is undesirable to have any wear, deterioration or other such factors which over a period of time might change the characteristics of the attenuator. Life usually must exceed 1 million steps or 100,000 rotations. The polygon shaped projection in combination with the resilient bars 79 and 80 provide a balanced system (when the polygon has an even number of sides) which has small wear. Moreover, the drum 50 may be moved out of one of its detended positions with less torque than is required with most other detent mechanisms. As a result, the forces exerted on the various parts of the device are reduced and the device is, therefore, reliable over the long term. Moreover, the detent operation does not in any way impair the broadband characteristics of the attenuator, or the impedance presented by any of the cards of the step attenuator.

I claim to have invented:

1. Apparatus for biasing a body, mounted for rotation about an axis, in any one of several predetermined angular positions comprising a shaft for said body, said shaft having an axis that corresponds to the axis of said body, said body including an element projecting away from said body, said element having an inner wall surrounding said shaft and spaced therefrom to form a cavity, said element having an outer wall farther from said axis than the inner wall, said outer wall having the shape of a polygon with each side of the polygon being a tangent of a circle whose center is on said axis, said element having a projection extending from said inner wall inwardly toward said axis, a stationary stop member extending into said cavity and which engages said projection to limit the angle of rotation of said body, each side of said polygon being of substantially equal length, and biasing means, comprising a substantially flat surface having a fixed angular position in a plane perpendicular to said axis and which constitutes a tangent to said circle pressing against any one of said sides of said polygon presented to it, for biasing the polygon into any one of several particular angular positions, said last-named means including a resilient element which enables the flat surface to move away from said axis so that the polygon can move from one of its angular positions to the next.

2. Apparatus as defined in claim 1 in which said biasing means comprises an elongated resilient bar supported at least at one end and free near its center, said bar having a flat surface for engaging the sides of the polygon.

3. Apparatus as defined in claim 2 in which said bar is supported at both of its ends.

4. Apparatus as defined in claim 1 in which the polygon has an even number of sides, said biasing means comprising two parallel resilient bars each having a flat surface, said two flat surfaces being positioned in contact with opposed sides of the polygon.

5. Apparatus as defined in claim 4 in which both of said bars are fixed at both of their free ends and are free between their fixed ends.

6. Apparatus as defined in claim 1 in which the polygon has an odd number of sides and at least five sides, said biasing means comprising two resilient bars each having a flat surface in contact with a side of the polygon, the sides of the polygon contacted by said bars being spaced apart by at least one intervening side.

7. Apparatus as defined in claim 6 in which both of said bars are fixed at both of their free ends and are free between their fixed ends.

8. Apparatus as defined in claim 1 comprising a fixed annular housing having its center coinciding with said axis, said annular housing having its wall of smaller diameter extending around said element of polygon shape, said biasing means including:

(a) a first resilient bar supported in fixed position along one tangent of said circle, and (b) a second resilient bar supported in either of two predetermined positions both of which are tangents to said circle, one of which positions is parallel to the first bar so that the two bars will contact opposing sides of the polygon when it has an even number of sides, the other of which positions is along a tangent that will enable the second bar to engage a side of the polygon which is spaced from the side engaging the first-named bar when a polygon having an odd number of sides is employed, and (c) said housing having notches in its aforesaid wall to receive the second resilient bar in either of said two positions.

9. Apparatus as defined in claim 1 including stop means for stopping the angular motion of the body in either angular direction while allowing the body to stop in as many predetermined angular positions as there are sides to the polygon.

10. Apparatus as defined in claim 1 in which said body comprises:

a central rotatable core having a shaft about which said core rotates, said element of polygon shape being mounted on one end of said core, and electrical switching means operated by said core to provide a different electrical switching circuit at each position of the body as determined by the coaction of said sides of said polygon and said biasing means.

11. Apparatus as defined in claim 1 in which said body comprising (a) a central metal cylindrical core having said shaft for rotating said core about said axis, (b) a plurality of elongated ultra-high frequency attenuators, one for each side of the polygon, said attenuator extending along the core parallel to the axis thereof and equally angularly spaced around the axis of the core, (c) each attenuator comprising an inner conductor, and an outer conductor surrounding the inner one, said core forming a part of said outer conductor, and (d) switching contacts at opposite ends of the inner conductor of each attenuator, an outer cylindrical casing surrounding said body and said contacts, and two coaxial connectors extending through said casing respectively near opposite ends thereof and respectively having inner conductors with contact points for respectively engaging the two switching contacts at the opposite ends of each attenuator, the coaxial connectors both having outer conductors electrically connected to said casing and to said core, said switching contacts being positioned so that a different pair thereof is in engagement with said two switching contact points in each angular position of said body.

12. Apparatus as defined in claim 11 in which said biasing means comprises an elongated resilient bar supported at least at one end and free near its center, said bar having a flat surface for engaging the sides of the polygon.

13. Apparatus as defined in claim 12 in which said bar is supported at both of its ends.

14. Apparatus as defined in claim 13 in which the polygon has an even number of sides, said biasing means comprising two parallel resilient bars each having a flat surface, said two flat surfaces being positioned in contact with opposed sides of the polygon.

15. Apparatus as defined in claim 14 in which both of said bars are fixed at both of their free ends and are free between their fixed ends.

16. Apparatus as defined in claim 11 in which the polygon has an odd number of sides and at least five sides, said biasing means comprising two resilient bars each having a flat surface in contact with a side of the polygon, the sides of the polygon contacted by said bars being spaced apart by at least one intervening side.

17. Apparatus as defined in claim 16 in which both of said bars are fixed at both of their free ends and are free between their fixed ends.

18. Apparatus as defined in claim 11 in which the body is adapted to be constructed in combination with either of at least two polygon shaped elements at least one of which has an even number of sides at at least one of which has an odd number of sides, a fixed annular housing having its center coinciding with said axis, said annular housing having its wall of smaller diameter extending around said element of polygon shape, said biasing means including:

(a) a first resilient bar supported in fixed position along one tangent of said circle, and (b) a second resilient bar supported in either of two predetermined positions both of which are tangents to said circle, one of which positions is parallel to the first bar so that the two bars will contact opposing sides of the polygon when it has an even number of sides, the other of which positions is along a tangent that will enable the second bar to engage a side of the polygon which is spaced from the side engaging the first-named bar when the polygon having an odd number of sides is employed, and (c) said housing having notches in its aforesaid wall to receive the second resilient bar in either of said two positions.

19. Apparatus as defined in claim 11 including stop means for stopping the angular motion of the body in either angular direction while allowing the body to stop in as many predetermined angular positions as there are sides to the polygon.

20. Apparatus as defined in claim 1 comprising:

a casing around said body, said casing having an end wall, said end wall forming a bearing for supporting one end of said shaft, said element projecting away from said body toward said end wall, said stationary stop member being supported by said end wall.

21. Apparatus defined in claim 20 in which said biasing means comprises a flat spring which is in face to face relation with one side of the polygon, said flat spring having first and second free ends held by said casing.

22. Apparatus as defined in claim 21 having a second flat spring having first and second free ends held by said casing, said second flat spring being mounted in face to face relation with a side of the polygon other than the side which is in face to face relation to the first flat spring.

23. Apparatus as defined in claim 22 in which said polygon has an even number of sides and said first and second flat springs respectively engage opposite sides of the polygon.

* * * * *